US010932547B2

(12) United States Patent
Lennings et al.

(10) Patent No.: US 10,932,547 B2
(45) **Date of Patent: *Mar. 2, 2021**

(54) CARRIER ASSEMBLY FOR A HARNESS

(71) Applicant: Globe (Jiangsu) Co., Ltd., Jiangsu (CN)

(72) Inventors: Eric Lennings, Huskvarna (SE); Emma Ekberg, Goeteborg (SE)

(73) Assignee: Globe (Jiangsu) Co., Ltd., Jiangsu (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/615,052

(22) PCT Filed: Sep. 27, 2017

(86) PCT No.: PCT/CN2017/103741

§ 371 (c)(1),
(2) Date: Nov. 19, 2019

(87) PCT Pub. No.: WO2019/061094

PCT Pub. Date: Apr. 4, 2019

(65) Prior Publication Data

US 2020/0178677 A1 Jun. 11, 2020

(51) Int. Cl.
*A45F 3/10* (2006.01)
*A45F 3/14* (2006.01)

(52) U.S. Cl.
CPC ..... *A45F 3/14* (2013.01); *A45F 3/10* (2013.01); *A45F 2003/142* (2013.01); *A45F 2003/144* (2013.01); *A45F 2003/146* (2013.01); *A45F 2200/0575* (2013.01)

(58) Field of Classification Search
CPC ..... A45F 3/08; A45F 3/10; A45F 3/14; A45F 2003/146; F16M 13/04
USPC ..... 224/631, 632
See application file for complete search history.

(56) References Cited

U.S. PATENT DOCUMENTS 4,298,149 A * 11/1981 Gottschalk ..... F16M 13/00 224/201
5,004,135 A * 4/1991 Dufournet ..... A45F 3/047 224/262
D342,666 S * 12/1993 DePack ..... D8/373
5,628,443 A * 5/1997 Deutsch ..... A45C 7/0086 150/113

(Continued)

FOREIGN PATENT DOCUMENTS

CA 2690446 A1 12/2008
CN 103371021 A 10/2013
EP 2653062 A1 10/2013

OTHER PUBLICATIONS

Search Report and Written Opinion in related International Patent Application No. PCT/US2017/103741 dated Jul. 20, 2018; 8 pages.

*Primary Examiner* — Justin M Larson
(74) *Attorney, Agent, or Firm* — Rooney IP, LLC

(57) ABSTRACT

A carrier assembly for a harness for carrying a backpack accessory, the carrier assembly including a back plate including connections for shoulder straps and an interface plate adapted to be attached to the backpack accessory. The back plate includes a coupling interface on a rear face arranged to be removably connected to a corresponding coupling interface on a front face of the interface plate.

12 Claims, 4 Drawing Sheets

(56) References Cited

U.S. PATENT DOCUMENTS 5,732,867 A * 3/1998 Perkins ..... A45F 3/08 224/271
5,887,836 A * 3/1999 Back ..... B63C 11/18 248/220.21
5,954,250 A * 9/1999 Hall ..... A62B 9/04 224/262
6,326,766 B1 * 12/2001 Small ..... H02J 7/0045 320/112
7,194,787 B2 * 3/2007 Murai ..... A44B 11/00 24/614
7,198,186 B2 * 4/2007 Kling ..... A62B 9/04 224/628
7,448,115 B2 * 11/2008 Howell ..... A41D 13/0012 24/3.12
7,591,401 B2 * 9/2009 Sandler ..... A45F 3/14 224/201
7,703,645 B2 * 4/2010 Moskun ..... A45F 3/08 224/581
7,810,684 B2 10/2010 May
8,622,268 B2 * 1/2014 Townsend ..... A62B 25/00 224/576
9,220,333 B2 * 12/2015 Losos ..... A45F 3/10
9,232,848 B2 * 1/2016 Krikorian ..... A45F 3/14
9,332,821 B2 * 5/2016 Janssen ..... A45F 3/04
9,668,567 B2 * 6/2017 Gill ..... A45F 3/08
10,230,077 B2 * 3/2019 Rief ..... A45F 3/04
D849,332 S * 5/2019 Ekberg ..... D29/124
10,299,570 B2 * 5/2019 Kim ..... A45F 3/04
10,813,437 B2 * 10/2020 Behringer ..... A45F 3/14
10,842,245 B2 * 11/2020 Revels ..... A45F 3/10
2005/0045686 A1 * 3/2005 Yeh ..... A45F 3/047 224/632
2011/0278339 A1 * 11/2011 Hexels ..... F41H 1/02 224/676
2015/0041512 A1 * 2/2015 Rief ..... A45F 3/04 224/633
2016/0270458 A1 * 9/2016 Conrad ..... H01M 2/1005
2016/0345714 A1 * 12/2016 Yamaoka ..... E01H 1/0809
2017/0105509 A1 4/2017 Gill et al.
2018/0228271 A1 * 8/2018 Rasmussen ..... A45F 3/08
2019/0074489 A1 * 3/2019 Yamaoka ..... A45F 3/04
2019/0110650 A1 * 4/2019 Mobarak ..... A47L 5/225
2020/0085172 A1 * 3/2020 Nordmann ..... B25F 5/02
2020/0085173 A1 * 3/2020 Nordmann ..... A45F 3/08
2020/0103073 A1 * 4/2020 Lennings ..... A45F 3/14
2020/0178677 A1 * 6/2020 Lennings ..... A45F 3/14
2020/0253360 A1 * 8/2020 Hahn ..... H01M 10/613
2020/0275763 A1 * 9/2020 Lennings ..... A45F 5/00
2020/0323312 A1 * 10/2020 Lennings ..... A45F 3/04

* cited by examiner

CARRIER ASSEMBLY FOR A HARNESS

TECHNICAL FIELD

The present invention relates generally to a carrier assembly for a harness for carrying a backpack accessory, such as an energy source, in particular a backpack battery pack, or other accessories used to carry tools, clothes, computers etc.

BACKGROUND ART

Backpack battery packs are known to be used with electrically operated handheld devices, in particular power tools such as hedge trimmers, clearing saws, chain saws, brush cutters, trimmers, blowers, screw drivers, drills, hammer drills, nail guns, staplers, polishing or grinding tools, etc.

Backpack battery packs have the advantage over conventional accumulator based cordless tools that larger battery packs, i.e. battery packs with larger capacities can be used. This in turn has the advantage that the overall operational time can be greatly enhanced.

Carrying battery packs for e.g. several hours of operating a respective handheld device on the back may be wearisome. Therefore, it is in particular desirable to provide possibilities to comfortably and conveniently carry energy sources on the back.

There exists a wide variety of carrier systems for such backpack energy sources or battery packs, as disclosed in e.g. WO 2013/139371, EP 3 106 565, US 2016/0006005 and EP 2 607 026. These prior art documents describe different solutions for providing an ergonomic design of the carrier harness together with a battery pack attached thereto.

Drawbacks associated with the prior art are that they employ to varying degrees custom-made connections between the harness and the battery pack which considerably limits the possibility for the user to combine and/or switch between different configurations of energy sources.

SUMMARY OF INVENTION

An object of the present invention is to provide an improved carrier assembly which allows the operator freedom of choice to connect any type of backpack accessory to the harness. This object is now achieved by a carrier assembly for a harness for carrying a backpack accessory according to a first aspect of the present invention, the carrier assembly comprising a back plate including connections for shoulder straps and an interface plate adapted to be attached to the backpack accessory, wherein the back plate comprises a coupling interface arranged to be removably connected to a corresponding coupling interface of the interface plate.

By providing an interface plate adapted to be attached to the backpack accessory and comprising a coupling interface arranged to be removably connected to a corresponding coupling interface on the back plate a modular solution is achieved. This allows for attachment of any suitable backpack accessory, e.g. diverse types of energy sources/battery packs, rucksacks or bags etc., to the back plate via the interface plate. The user will then no longer be limited to specific combinations of backpack accessories and harnesses as known from the prior art.

In a preferred embodiment, the coupling interface of the back plate is adapted to be connected to and disconnected from the coupling interface of the interface plate in an at least partially translational or linear movement which is substantially parallel to the back plate. Thus, a sliding motion for connection and disconnection of the interface plate from the back plate is achieved.

In an advantageous embodiment, the coupling interface of the back plate comprises two parallel raised ridges, each having at least one overhanging flange facing towards or away from each other, and the coupling interface of the interface plate comprises corresponding raised ridges, each having at least one overhanging flange facing in the opposite direction of the corresponding flanges of the back plate, wherein the ridges are arranged such that when the back plate and the interface plate are aligned with each other and brought together in a translational or linear movement parallel to the ridges, the flanges are slid into locking engagement with each other to retain the interface plate on the back plate. The solution with the raised ridges and overhanging flanges provides a secure connection between the interface plate and the back plate which ensures that the interface plate cannot be removed from the back plate in a direction perpendicular to the surface of the back plate.

In a preferred embodiment, the raised ridges extend in a substantially longitudinal direction of the back plate. Alternatively, the raised ridges extend in a substantially transversal direction of the back plate. The orientation of the raised ridges define the insertion direction of the interface plate onto the back plate, either longitudinal or transversal.

In an alternative embodiment, a first end of the ridges of the interface plate each comprises a locking projection extending in a direction perpendicular to the longitudinal extension of the ridge and facing towards each other, wherein the back plate comprises a pair of resilient locking tabs arranged to come into locking engagement with the locking projections at the end of the translational or linear movement between the interface plate and the back plate parallel to the ridges. The locking engagement ensures that the interface plate remains in place on the back plate during use, In a further preferred embodiment, the resilient locking tabs are formed as ribs extending in a longitudinal direction of the back plate into an opening therein and comprise a main portion having a lateral projection adapted to engage the locking projections of the interface plate, and a web portion connecting a distal end of the main portion to a central rib arranged between and at a distance from the locking tabs. The resilient locking tabs may easily be disengaged from the locking projections to allow removal of the interface plate from the back plate. The web portion acts to bias the resilient locking tab towards the locking engagement position.

In an advantageous embodiment, the interface plate comprises an abutment member which protrudes from the surface of the interface plate on the same face as the raised ridges adjacent a second end of the ridges, wherein the abutment member is arranged to engage a top edge of the back plate when the interface plate has been brought together with the back plate in order to define a stop position of the translational or linear movement. The abutment member provides a stop for the interface plate such that it is prevented from moving further in relation to the back plate.

In a preferred embodiment, a distal side of the locking projections in an insertion direction of the interface plate has a bevelled or chamfered surface. In addition, or as an alternative, a proximal side of the resilient locking tabs in an insertion direction of the interface plate has a bevelled or chamfered surface. The bevelled or chamfered surfaces act to smoothly deflect the resilient locking tab laterally when the interface plate is inserted into the back plate by translational or linear movement, such that the locking projections can move past the resilient locking tabs. Once the locking projections have passed the resilient locking tabs, the latter spring back into locking engagement with the locking projections.

In an alternative embodiment, leading and/or trailing edges of the flanges in an insertion direction of the interface plate has a bevelled or chamfered surface. The bevelled or chamfered surfaces provide a smooth sliding motion when inserting the interface plate onto the back plate.

In a second aspect of the present invention, there is provided a harness comprising a carrier assembly according to the first aspect.

BRIEF DESCRIPTION OF DRAWINGS

The invention is now described, by way of example, with reference to the accompanying drawings, in which.

DESCRIPTION OF EMBODIMENTS

Figure 1A:
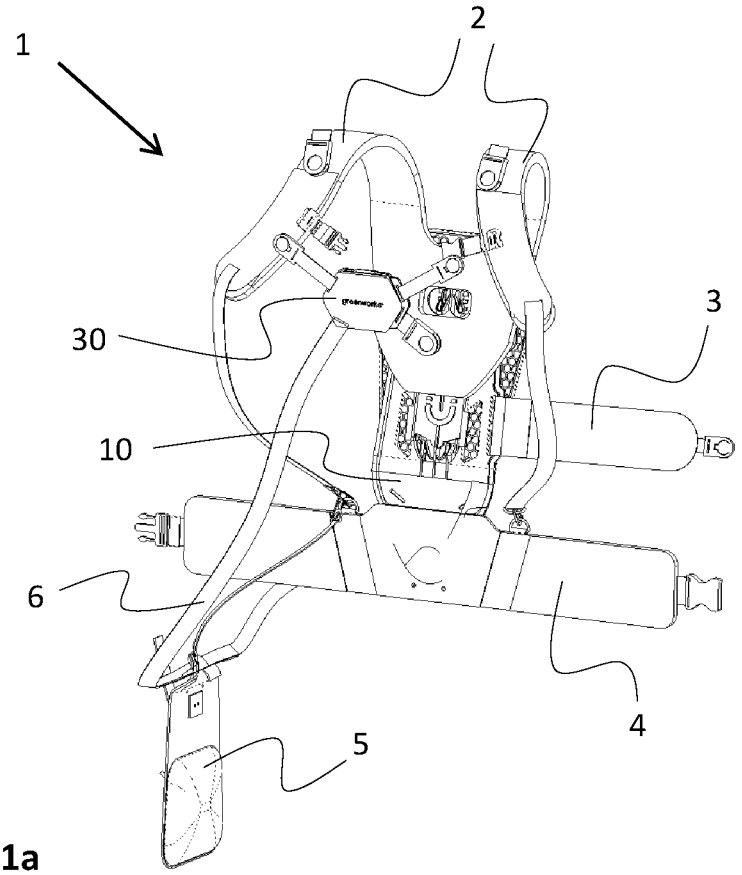
FIGS. 1*a* and 1*b* show front and rear perspective views, respectively, of an exemplary harness comprising a carrier assembly according to the present invention.

In the following, a detailed description of a carrier assembly according to the invention is presented. In the drawing figures, like reference numerals designate identical or corresponding elements throughout the several figures. It will be appreciated that these figures are for illustration only and are not in any way to be seen as restricting the scope of the invention.

In the context of the present invention, the terms 'front' and 'rear' shall be interpreted in relation to the operator when wearing the harness including the carrier assembly. Thus, surfaces facing in the forward direction of the operator shall be designated front faces and surfaces facing in the opposite, backward direction of the operator shall be designated rear faces.

Figure 1B:
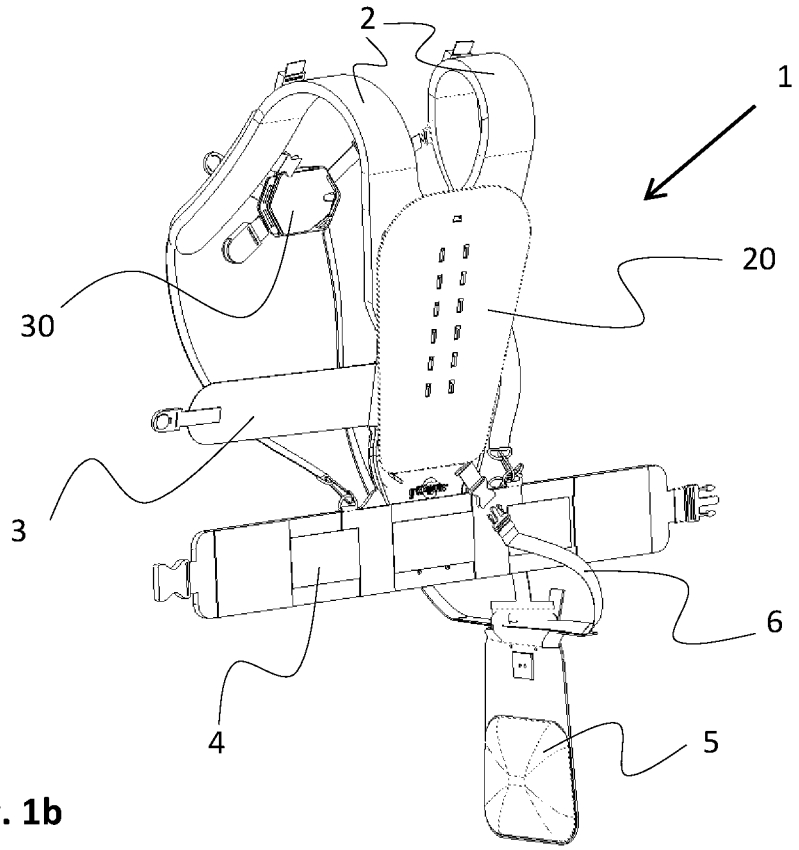

FIGS. 1*a* and 1*b* show in perspective views the front and rear of an exemplary harness 1 for carrying a handheld, motor-driven power tool (not shown) of the kind described in the introductory portion, which may be used together with a carrier assembly according to the present invention. The harness 1 comprises a pair of shoulder straps 2 to be worn on the shoulders by the operator. The shoulder straps 2 are connected to a back plate 10 by means of a carrier assembly (not shown). Attached on the rear face of the back plate 10, there is shown an interface plate 20 which together with the back plate 10 form a carrier assembly according to the present invention, as will explained more in detail below. Further, on one side of the back plate 10 there is attached a side strap 3 for providing additional stability and support when carrying the power tool. In a bottom portion of the back plate 10, a hip belt 4 is attached to be worn around the hips by the operator. On the opposite side of the side strap 3, there is provided a hip plate 5 comprising means (not shown) for attaching the power tool. The hip plate 5 is connected to the harness 1 by means of strap 6, which attaches to the back plate 10 on the rear face of the harness 1, as shown in FIG. 1*b*. On the rear face of the harness 1, there is provided a chest buckle 30 arranged for attachment of the strap 6 for the hip plate 5, the side strap 3 and connecting straps to the shoulder straps 2 to keep the harness 1 in place on the body of the operator during use and allow for distribution of forces caused by the weight of the power tool.

The harness 1 is designed to provide a comfortable fit for the operator, distribute the forces caused by the weight of the power tool and allow freedom of movement for the operator during operation of the power tool.

As mentioned above, one of the objects of the present invention is to provide an improved carrier assembly which allows the operator freedom of choice to connect any type of backpack accessory to the harness. To this end, a carrier assembly for the connection between the back plate 10 and an interface plate 20 is provided.

Figure 2A:
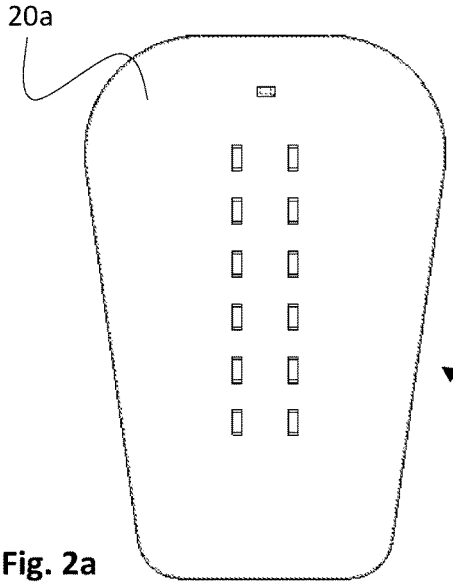
FIGS. 2*a* and 2*b* show front and rear face views, respectively, of an interface plate forming part of a carrier assembly according to the present invention.
Figure 2B:
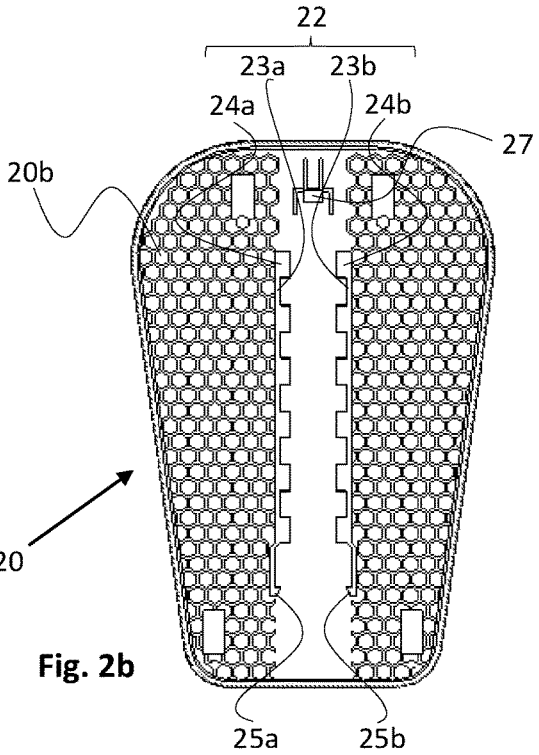

In FIGS. 2*a* and 2*b*, an interface plate 20 of the carrier assembly is illustrated in rear and front views, respectively. FIG. 2*a* shows the rear face 20*a* of the interface plate 20. The rear face 20*a* provides a surface for attachment of any suitable backpack accessory thereto, such as e.g. a battery pack, a bag or rucksack or any other kind of article that the operator may wish to carry on the back when wearing the harness 1. The interface plate 20 may be attached to the backpack accessory in any suitable manner, for instance by gluing, welding, riveting, stitching, screwing, strapping etc. Subsequently, the operator may attach the interface plate 20 onto the back plate 10 of the harness 1.

Figure 3A:
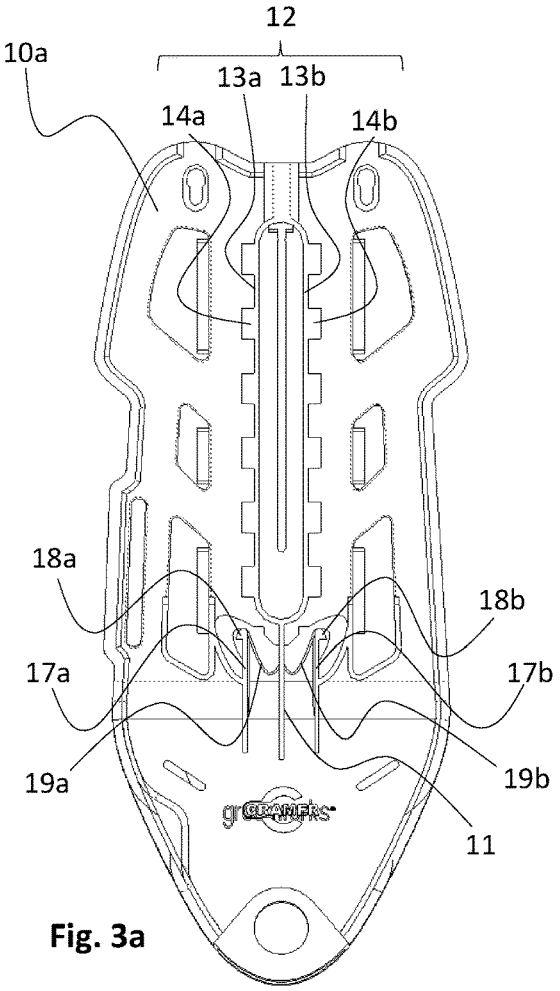
FIGS. 3*a* and 3*b* show front and rear face views, respectively, of a back plate forming part of a carrier assembly according to the present invention.

The front face 20*b* of the interface plate 20 as shown in FIG. 2*b* is arranged to face the rear face 10*a* of the back plate 10, as shown in FIG. 3*a*. Laterally on each side of the interface plate 20 there is provided connection means 21 for attaching shoulder straps 2 of a harness 1, e.g. such as shown in FIGS. 1*a* and 1*b*. The connection means 21 may comprise slots for passage of the shoulder straps 2 there through, or other suitable means for attaching the shoulder straps 2. A coupling interface 22 of the interface plate 20 is arranged on the rear face 20*a* and comprises two parallel raised ridges 23*a*, 23*b*. The raised ridges 23*a*, 23*b* extend in a longitudinal direction of the interface plate 20 which coincides with the insertion direction of the interface plate 20 onto the back plate 10 when assembling the carrier assembly.

Figure 4:
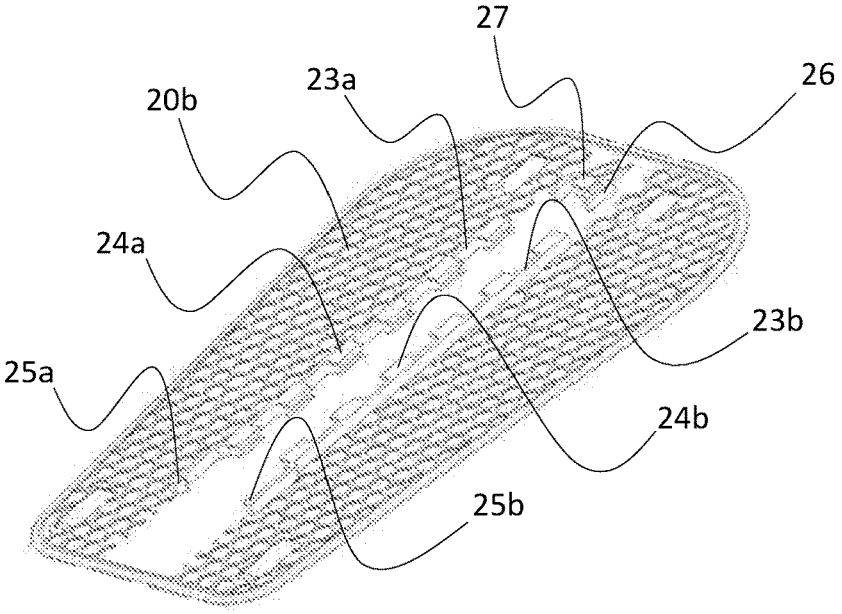
FIG. 4 shows a perspective view of the front face of the interface plate of FIGS. 2*a* and 2*b;*

Each of the raised ridges 23*a*, 23*b* comprises at least one overhanging flange 24*a*, 24*b*, more clearly shown in FIG. 4. The flanges 24*a*, 24*b* may comprise a plurality of regularly spaced apart flanges along the raised ridges 23*a*, 23*b* as shown in FIGS. 2*a* and 4, or may comprise a single continuous flange (not shown) along the length of the raised ridges 23*a*, 23*b*. The flanges 24*a*, 24*b* and the raised ridges 23*a*, 23*b* together present an L-shaped cross section.

Figure 3B:
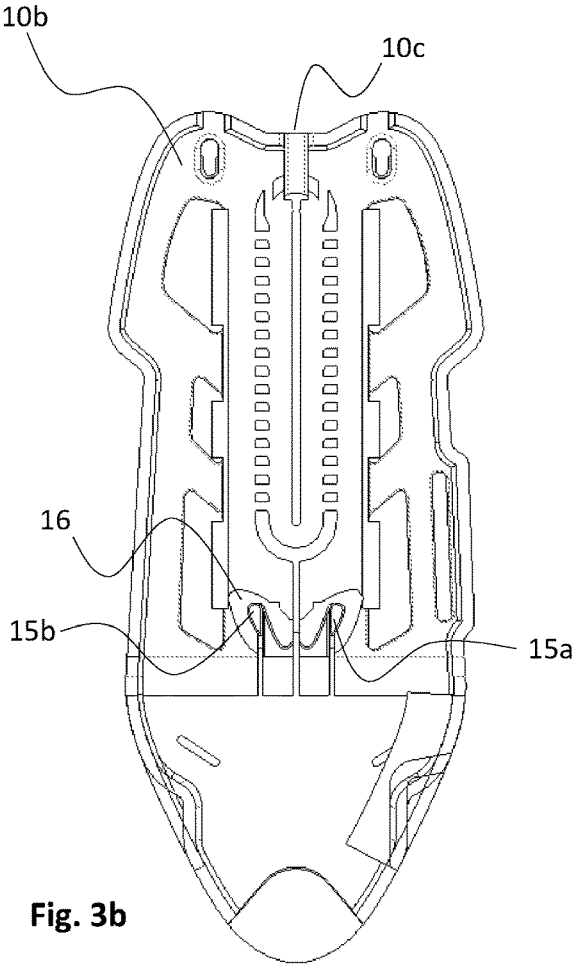

In FIGS. 3*a* and 3*b*, a back plate 10 of the carrier assembly is illustrated in rear and front views, respectively. The back plate 10 similarly comprises a corresponding coupling interface 12 on its rear face 10*a*, arranged to face the front face 20*b* of the interface plate 20, and comprising two parallel raised ridges 13*a*, 13*b*. The raised ridges 13*a*, 13*b* extend in a longitudinal direction of the back plate 10 which coincides with the insertion direction of the interface plate 20 onto the back plate 10 when assembling the carrier assembly.

Figure 5:
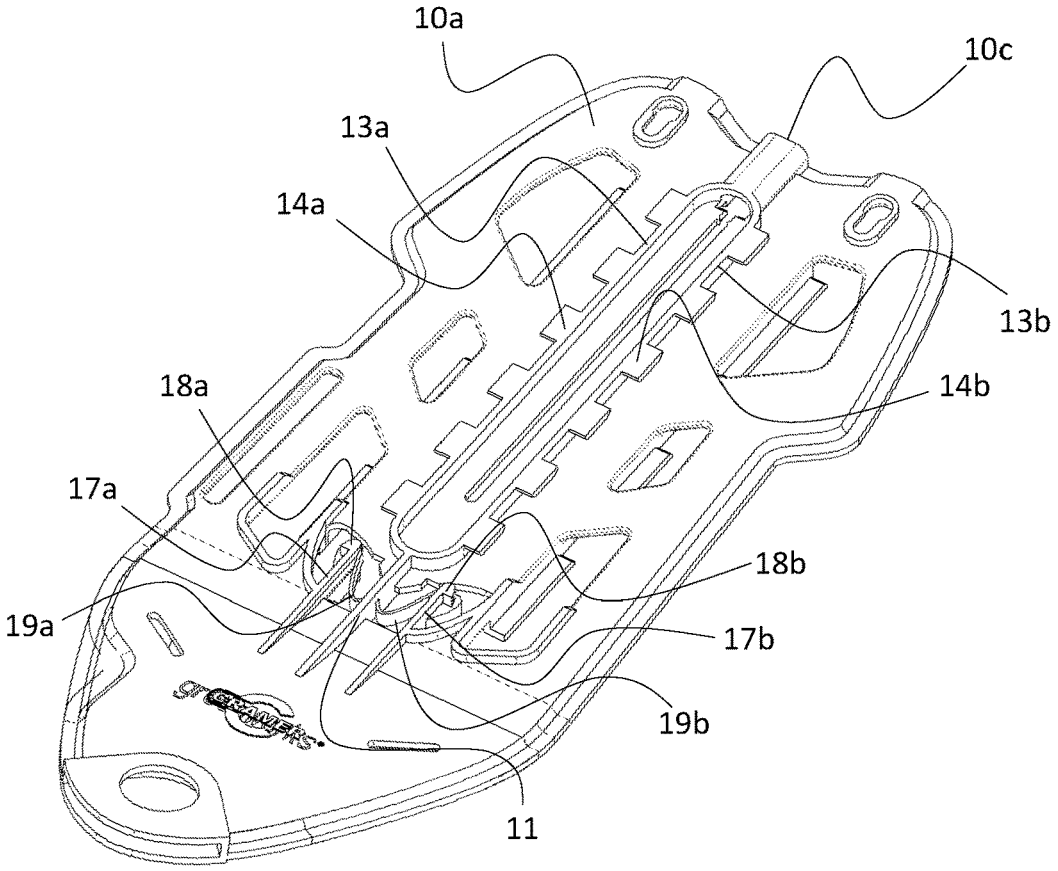
FIG. 5 shows a perspective view of the rear face of the back plate of FIGS. 3*a* and 3*b;*
Figure 6:
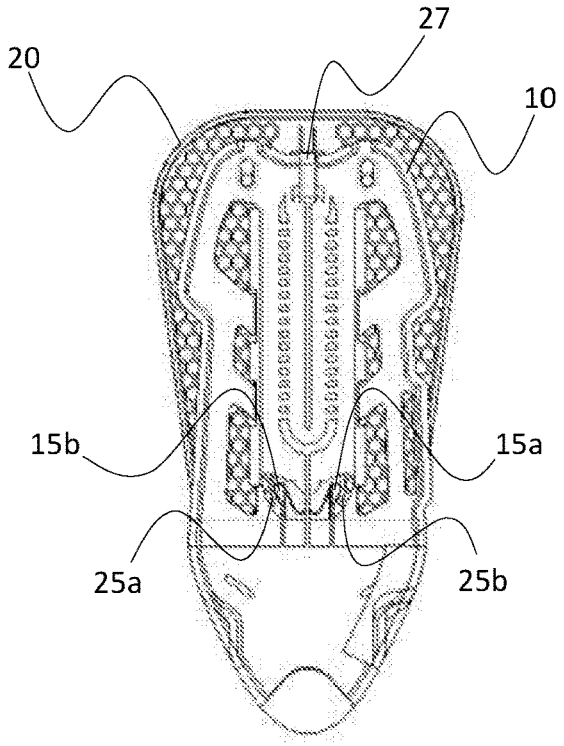
FIG. 6 shows a front face view of the interface plate and the back plate of the carrier assembly according to the present invention assembled together.
Figure 7:
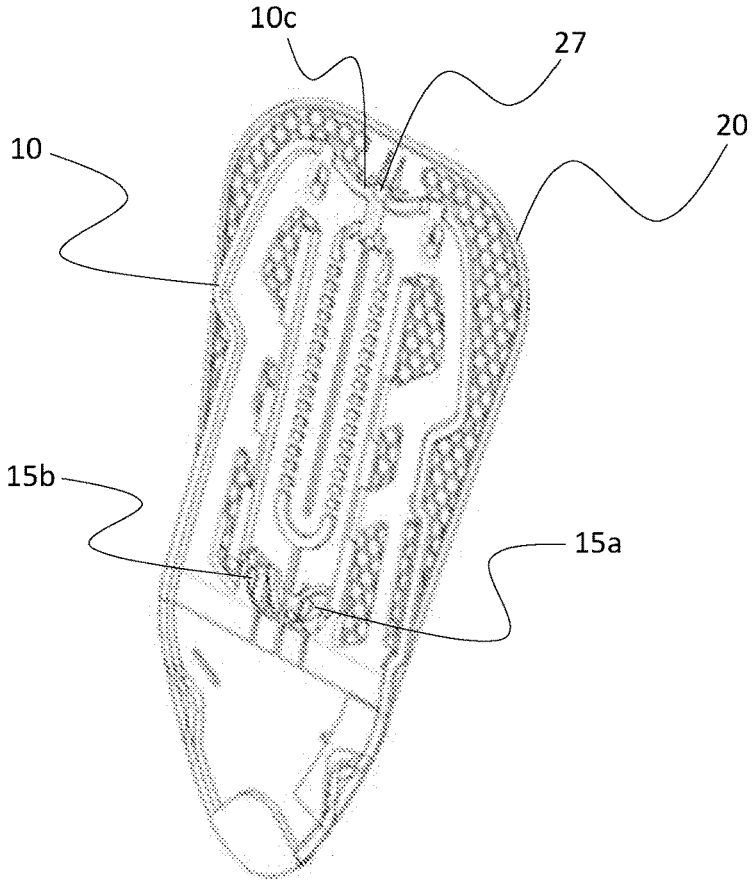
FIG. 7 shows a front perspective view of the interface plate and the back plate of the carrier assembly according to the present invention assembled together.

Each of the raised ridges 13*a*, 13*b* comprises at least one overhanging flange 14*a*, 14*b*, more clearly shown in FIG. 5. The flanges 14*a*, 14*b* may comprise a plurality of regularly spaced apart flanges along the raised ridges 13*a*, 13*b* as shown in FIGS. 3*a* and 5, or may comprise a single continuous flange (not shown) along the length of the raised ridges 13*a*, 13*b*. The flanges 14*a*, 14*b* and the raised ridges 13*a*, 13*b* together present an L-shaped cross section.

The distance between the raised ridges 13*a*, 13*b* of the back plate 10 and the raised ridges 23*a*, 23*b* of the interface plate 20 is adapted such that when the interface plate 20 is aligned with the back plate 10 they may be brought together in a translational or linear movement using a sliding motion parallel to the raised ridges 13*a*, 13*b*; 23*a*, 23*b*. The sliding motion is effected substantially in a longitudinal direction of the back plate 10. As the interface plate 20 and back plate 10 are assembled together, the flanges 24*a*, 24*b* of the interface plate 20 are slid into locking engagement with the flanges 14*a*, 14*b* of the back plate 10. Thus, the interface plate 20 and the back plate 10 are prevented from being separated in a direction perpendicular to the plane defined by the back plate 10.

The back plate 10 further comprises a through-going opening 16 arranged centrally between the raised ridges 13*a*, 13*b*. A pair of resilient locking tabs 15*a*, 15*b* extend into the opening 16 in a direction substantially parallel to the raised ridges 13*a*, 13*b*. The locking tabs 15*a*, 15*b* are formed as ribs and comprise a main portion 17*a*, 17*b* having a lateral projection 18*a*, 18*b* at a distal, free end thereof. The resilient locking tabs 15*a*, 15*b* are oriented in the opposite direction of the insertion direction of the interface plate 20 onto the back plate 10, which is downwards in FIGS. 2*a* and 2*b*; 3*a* and 3*b*. Additionally, the distal end of the main portion 17*a*, 17*b* are connected to a central rib 11, which bisects the opening 16, by means of web portions 19*a*, 19*b*. The web portions 19*a*, 19*b* act as springs to bias the locking tabs 15*a*, 15*b* laterally outward, away from the central rib 11.

The central rib 11 extends parallel to the raised ridges 13*a*, 13*b* at equal distance from the locking tabs 15*a*, 15*b*. In one embodiment, the central rib 11 extends beyond the opening 16 and connects to the raised ridges 13*a*, 13*b* which join together in a semi-circular shape at a lower end.

Referring now to FIGS. 2*b* and 4, the front face 20*b* of the back plate 20 comprises a pair of locking projections 25*a*, 25*b* arranged at or adjacent a lower end of the raised ridges 23*a*, 23*b*. The locking projections 25*a*, 25*b* comprise a lateral engagement surface oriented substantially perpendicular to and facing in the opposite direction of the insertion direction of the interface plate 20 onto the back plate 10.

The resilient locking tabs 15*a*, 15*b* of the back plate 10 are arranged to come into locking engagement with the locking projections 25*a*, 25*b* of the back plate 20 when the carrier assembly is assembled. To this end, the lateral projections 18*a*, 18*b* on the resilient locking tabs 15*a*, 15*b* comprise a transversal surface, substantially perpendicular to and facing in the insertion direction of the interface plate 20. During insertion of the interface plate 20 onto the back plate 10, the resilient locking tabs 15*a*, 15*b* are deflected laterally inwards toward the central rib 11 by the operator. When the end position of the interface plate 20 been reached, the web portions 19*a*, 19*b* act on the main portions 17*a*, 17*b* to bias the locking tabs 15*a*, 15*b* away from the central rib 11 such that the lateral projections 18*a*, 18*b* engage the pair of locking projections 25*a*, 25*b* to ensure that the interface plate 20 cannot move in relation to the back plate 10. To release the locking engagement between the resilient locking tabs 15*a*, 15*b* and the locking projections 25*a*, 25*b*, the operator simply deflects the locking tabs 15*a*, 15 by a two-finger grip and slides the interface plate 20 upwardly in relation to the back plate 10.

In order to facilitate smooth operation of the sliding motion, the distal side of the locking tabs 25*a*, 25*b* in the insertion direction of the interface plate 20 onto the back plate 10 and/or the distal end of the locking projections 15*a*; 15*b* may comprise a bevelled or chamfered surface. In a similar fashion, leading and trailing edges of the flanges 14*a*, 14*b*; 24*a*, 24*b* in the insertion direction of the interface plate 20 may comprise bevelled or chamfered surfaces.

Arranged in the upper portion of the interface plate 20, there is provided an abutment member 26 which protrudes from the front face 20*b* in a position proximal to a second end of the raised ridges 23*a*, 23*b* in the insertion direction of the interface plate 20. The abutment member 26 is arranged to engage a top edge 10*c* of the back plate 10 when the interface plate 20 has been brought together with the back plate 10 in order to define a stop position of the translational or linear insertion movement. To this end, the abutment member 26 comprises a flange 27 extending distally in the insertion direction of the interface plate 20, thus presenting an L-shaped cross section. The abutment member 26 with the flange 27 is adapted to hook onto the top edge 10*c* and ensure that the interface plate 20 cannot move further downwards with respect to the back plate 10.

The invention claimed is:

1. A carrier assembly for a harness for carrying a backpack accessory, the carrier assembly comprising a back plate including connections for shoulder straps and an interface plate adapted to be attached to the backpack accessory, wherein the back plate comprises a coupling interface on a rear face thereof arranged to be removably connected to a corresponding coupling interface on a front face of the interface plate;

wherein the coupling interface of the back plate comprises two parallel raised ridges, each having at least one overhanging flange and presenting an L-shaped cross section with the flanges facing towards or away from each other, and the coupling interface of the interface plate comprises corresponding raised ridges, each having at least one overhanging flange and presenting an L-shaped cross section with the flanges facing in the opposite direction of the corresponding flanges of the back plate, wherein the raised ridges are arranged such that when the back plate and the interface plate are aligned with each other and brought together in a translational or linear movement parallel to the raised ridges, the flanges are slid into locking engagement with each other to retain the interface plate on the back plate; and wherein a first end of the raised ridges of the interface plate each comprises a locking projection extending in a direction perpendicular to the longitudinal extension of the raised ridges and facing towards each other, wherein the back plate comprises a pair of resilient locking tabs arranged to come into locking engagement with the locking projections at the end of the translational or linear movement between the interface plate and the back plate parallel to the raised ridges.

2. The carrier assembly according to claim 1, wherein the coupling interface of the back plate is adapted to be connected to and disconnected from the coupling interface of the interface plate in an at least partially translational or linear movement which is substantially parallel to the back plate.

3. The carrier assembly according to claim 1, wherein the raised ridges extend in a substantially longitudinal direction of the back plate.

4. The carrier assembly according to claim 1, wherein the raised ridges extend in a substantially transversal direction of the back plate.

5. The carrier assembly according to claim 1, wherein the resilient locking tabs are formed as ribs extending in a longitudinal direction of the back plate into an opening therein and each comprise a main portion having a lateral projection adapted to engage the locking projections of the interface plate, and a web portion connecting a distal end of the main portion to a central rib arranged between and at a distance from the resilient locking tabs.

6. The carrier assembly according to claim 1, wherein a distal side of the locking projections in an insertion direction of the interface plate have a beveled or chamfered surface.

7. The carrier assembly according to claim 1, wherein a distal end of the resilient locking tabs has a bevelled or chamfered surface.

8. A harness comprising a carrier assembly according to claim 1.

9. A carrier assembly for a harness for carrying a backpack accessory, the carrier assembly comprising a back plate including connections for shoulder straps and an interface plate adapted to be attached to the backpack accessory, wherein the back plate comprises a coupling interface on a rear face thereof arranged to be removably connected to a corresponding coupling interface on a front face of the interface plate;

wherein the coupling interface of the back plate comprises two parallel raised ridges, each having at least one overhanging flange and presenting an L-shaped cross section with the flanges facing towards or away from each other, and the coupling interface of the interface plate comprises corresponding raised ridges, each having at least one overhanging flange and presenting an L-shaped cross section with the flanges facing in the opposite direction of the corresponding flanges of the back plate, wherein the raised ridges are arranged such that when the back plate and the interface plate are aligned with each other and brought together in a translational or linear movement parallel to the raised ridges, the flanges are slid into locking engagement with each other to retain the interface plate on the back plate; and wherein the interface plate comprises an abutment member which protrudes from the front face of the interface plate adjacent a second end of the raised ridges, wherein the abutment member is arranged to engage a top edge of the back plate when the interface plate has been brought together with the back plate in order to define a stop position of the translational or linear movement.

10. A harness comprising a carrier assembly according to claim 9.

11. A carrier assembly for a harness for carrying a backpack accessory, the carrier assembly comprising a back plate including connections for shoulder straps and an interface plate adapted to be attached to the backpack accessory, wherein the back plate comprises a coupling interface on a rear face thereof arranged to be removably connected to a corresponding coupling interface on a front face of the interface plate;

wherein the coupling interface of the back plate comprises two parallel raised ridges, each having at least one overhanging flange and presenting an L-shaped cross section with the flanges facing towards or away from each other, and the coupling interface of the interface plate comprises corresponding raised ridges, each having at least one overhanging flange and presenting an L-shaped cross section with the flanges facing in the opposite direction of the corresponding flanges of the back plate, wherein the raised ridges are arranged such that when the back plate and the interface plate are aligned with each other and brought together in a translational or linear movement parallel to the raised ridges, the flanges are slid into locking engagement with each other to retain the interface plate on the back plate; and wherein leading and/or trailing edges of the flanges in an insertion direction of the interface plate has a bevelled or chamfered surface.

12. A harness comprising a carrier assembly according to claim 11.

* * * * *